US006595000B2

(12) United States Patent
Lavie et al.

(10) Patent No.: US 6,595,000 B2
(45) Date of Patent: Jul. 22, 2003

(54) METHOD OF ASSEMBLING A FUEL INJECTOR FOR THE COMBUSTION CHAMBER OF A TURBOMACHINE

(75) Inventors: Alain Lavie, Yerres (FR); Stéphanie Martelli, Paris (FR); Marion Michau, Vincennes (FR); José Rodrigues, Nandy (FR); Alain Tiepel, Chailly en Biere (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/988,526

(22) Filed: Nov. 20, 2001

(65) Prior Publication Data

US 2002/0073708 A1 Jun. 20, 2002

(30) Foreign Application Priority Data

Nov. 21, 2000 (FR) ..... 00 15003

(51) Int. Cl.[7] ..... F02C 1/00; F02G 3/00

(52) U.S. Cl. ..... 60/740; 60/742; 29/428; 29/890.131; 228/245

(58) Field of Search ..... 60/740, 742, 746, 60/747, 730, 733, 39.463, 39.462; 239/132.1, 132.3, 132.5; 123/468, 469; 29/888.46, 890.124, 890.131, 428; 228/245–255

(56) References Cited

U.S. PATENT DOCUMENTS

| | | | | |
|---|---|---|---|---|
| 5,423,178 A | | 6/1995 | Mains | 60/39.06 |
| 5,568,721 A | * | 10/1996 | Alary et al. | 60/39.03 |
| 5,570,580 A | * | 11/1996 | Mains | 60/747 |
| 5,988,531 A | * | 11/1999 | Maden et al. | 239/406 |
| 6,098,407 A | * | 8/2000 | Korzendorfer et al. | 60/737 |
| 6,351,948 B1 | * | 3/2002 | Goeddeke | 60/740 |

* cited by examiner

*Primary Examiner*—Charles G. Freay
*Assistant Examiner*—Han L Liu
(74) *Attorney, Agent, or Firm*—Oblon, Spivak, McClelland, Maier & Neustadt, P.C.

(57) ABSTRACT

An assembly method in which a brazing metal is initially filled into radial wells pierced in an annular injection piece having first injection orifices for discharging a primary fuel, and in a cylindrical endpiece surrounding the annular injection piece and having secondary injection orifices for discharging a secondary fuel; thereafter the annular injection piece is fitted inside the cylindrical endpiece and these pieces are together fitted on a first tube for feeding primary fuel and a second tube for feeding secondary fuel and surrounding the first tube, and also to an outer wall of the injector; finally, the end portion of the injector as assembled in this way is placed in an enclosure where it is heated so as to melt the brazing metal to unite the parts.

15 Claims, 5 Drawing Sheets

14,16
172
20
204
202
160
200
159a
170
193
176
177a
178
194
166
165a
196
164
175a
156
174
186
162
158
184
188
154
190
152
198
182
166b
175b
192
196
168
182b
166a
180
166c
177b
194
193
159b
IV
III
165a
192
182a
182c
196
166
194
165c
165b
164
182b 192
196
156
158
194
152

METHOD OF ASSEMBLING A FUEL INJECTOR FOR THE COMBUSTION CHAMBER OF A TURBOMACHINE

FIELD OF THE INVENTION

The present invention relates to the general field of fuel injectors in turbomachines and it relates more particularly to assembling injectors for a two-headed combustion chamber in such a turbomachine.

PRIOR ART

In two-headed combustion chambers, a turbojet or a turboprop (referred to below in the present description as a "turbomachine") is started and kept idling using so-called "pilot" injectors, while "main" injectors are used only when cruising. Pilot injectors are fed with fuel on a permanent basis whereas main injectors are fed only once the turbomachine is rotating at more than some minimum determined speed (generally lying in the range 10% to 30% of its nominal speed). Furthermore, during so-called "stage-burning", only half of the main injectors are in operation, with the other half of the main injectors then being temporarily stopped.

Various types of injector architecture are known. Thus, international patent application WO 94/08179 shows a conventional two-headed structure for which the main injector is shown in FIG. 3 and the pilot injector in FIG. 4. Each of those two injectors is essentially characterized by a terminal portion including a large number of parts and requiring sealing gaskets to ensure that the primary and secondary circuits are sealed from each other.

This results firstly in such injectors being complex to manufacture and assemble, and secondly, under certain operating conditions and in particular at high temperatures, in performance being degraded because of a considerable reduction in the lifetime of the combustion chamber and/or of the turbine, or indeed because of destruction of the injector and corresponding destruction of the turbomachine.

OBJECT AND DEFINITION OF THE INVENTION

The present invention provides a method of assembling the end portion of an injector which mitigates the above-mentioned drawbacks. An object of the invention is thus to make the end portion with a minimum number of parts and in a small space. Another object of the invention is to integrate a cooling circuit in this end portion of an injector so as to enable the injector to be used at very high temperature.

These objects are achieved by a method of assembling the end portion of an injector for a turbomachine combustion chamber, the injector comprising means for delivering primary fuel, said means comprising a first feed tube connected to an injection piece having first injection orifices for discharging the primary fuel into said combustion chamber, and means for delivering a secondary fuel, said means comprising a second feed tube surrounding said first tube and connected to a cylindrical endpiece surrounding said annular injection piece and having second injection orifices for discharging the secondary fuel into said combustion chamber, wherein said cylindrical endpiece and said annular injection piece are provided with radial wells for receiving a brazing metal, and said wells are initially filled with said brazing metal; thereafter said annular injection piece is fitted in said cylindrical endpiece and these pieces are together fitted on said first and second tubes for feeding primary and secondary fuel, and to an outer wall of the injector; finally the end portion of the injector as assembled in this way is placed in an enclosure where it is heated so as to cause the brazing metal to melt and unite the parts.

By using this brazing technique, assembly of the end portion of an injector is made considerably simpler, and very reliable, while also being accelerated. Furthermore, the very small number of parts required for making such an injector end portion (only two parts fitted to the ends of the feed tubes in the preferred embodiment) considerably facilitates subsequent maintenance.

Advantageously, said annular injection piece is fitted on said first feed tube via a cylindrical connection piece including radial wells for receiving the brazing metal. Adding this third part enables the machining of the annular injection piece to be simplified and facilitates possible replacement thereof.

In an embodiment more particularly intended for assembling a main injector, prior to fitting said outer wall of the injector, a separator wall is fitted in said cylindrical endpiece, with a downstream end of said wall being fixed on a third tube for delivering a cooling fluid surrounding said first and second feed tubes.

The brazing metal is preferably based on gold or nickel, and the enclosure is raised to a determined temperature lying in the range 600° C. to 1100° C. as a function of the nature of the parts to be assembled together and of the brazing metal used.

The present invention also provides a terminal portion of a fuel injector for a turbomachine combustion chamber made using the above-specified brazing assembly method.

BRIEF DESCRIPTION OF THE DRAWINGS

The characteristics and advantages of the present invention appear more clearly from the following description given by way of non-limiting indication and made with reference to the accompanying drawings, in which.

DETAILED DESCRIPTION OF A PREFERRED EMBODIMENT

Figure 1:
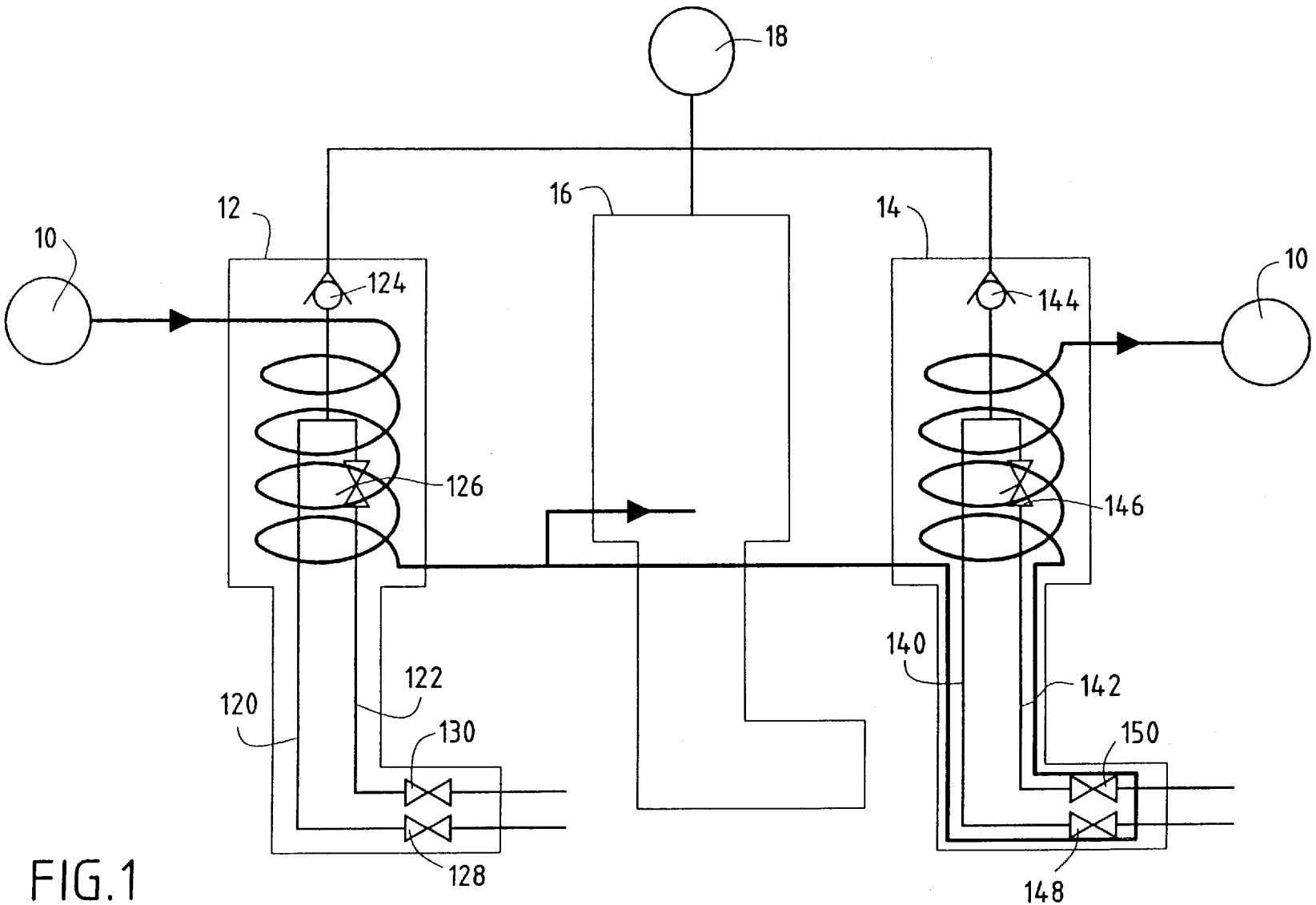
FIG. 1 is a diagrammatic view showing the cooling circuit for fuel injectors in a turbomachine.

FIG. 1 is a schematic showing the fuel and cooling circuits for injectors in a two-headed annular combustion chamber of a turbomachine.

The cooling circuit is shown only for two injectors so as to make it easier to understand (such a combustion chamber can have as many as 20 pilot injectors and 40 main injectors, for example, where such numbers are not limiting), and it is fed from a feed source 10 by a cooling fluid which is optionally independent (such as oil, water, or any other suitable fluid) which passes firstly through a "pilot" injector 12 for starting the turbomachine and for running it while idling (at low power), and then fed in parallel to two "main" injectors 14, 16 (organized on the basis of one even rank and one odd rank), which injectors enable the machine to operate during cruising stages (and in particular at full power). The cooling fluid then returns to the feed source 10, thereby closing the cooling circuit (naturally this circuit also includes in conventional manner a cooling fluid feed pump, filters, and various hydraulic members for controlling the flow rate of this fluid).

The structure of the pilot and main injectors is of aviation type and is identical concerning the fuel circuits and control thereof, each injector having two fuel circuits comprising a primary circuit 120, 140 for low flow rates and a secondary circuit 122, 142 for high flow rates. A check valve 124, 144 cuts off a stopped injector from a fuel feed source 18 and a metering valve 126, 146 controls the secondary circuit so as to guarantee good performance when switching over between the primary and secondary circuits. Each circuit is also provided at its terminal portion with a swirler 128, 130; 148, 150 of a shape to ensure that the fuel is atomized (set into rotation).

In the pilot injectors 12, the cooling circuit does no more than surround the head end of metering valve 126, whereas in the main injectors 14, 16, the cooling circuit extends to the terminal end or tip of such an injector prior to returning towards the metering valve 146 which it also surrounds in full. It is known that the problem of coke formation is present essentially at the main injectors since they can be subjected to high temperatures while they have no fuel flowing through them during certain stages of operation (idling, stage-burning) whereas the temperature at the ends of the pilot injectors never exceeds the coking limit (150° C.) because fluid flows therethrough during all stages of operation. Under such circumstances, there is no need in principle to cool the ends of the pilot injectors. Nevertheless, there is nothing to prevent an identical cooling structure being adopted for both types of injector, and that would enable the general process of machining the injectors to be simplified.

Figures 2, 3, 4:
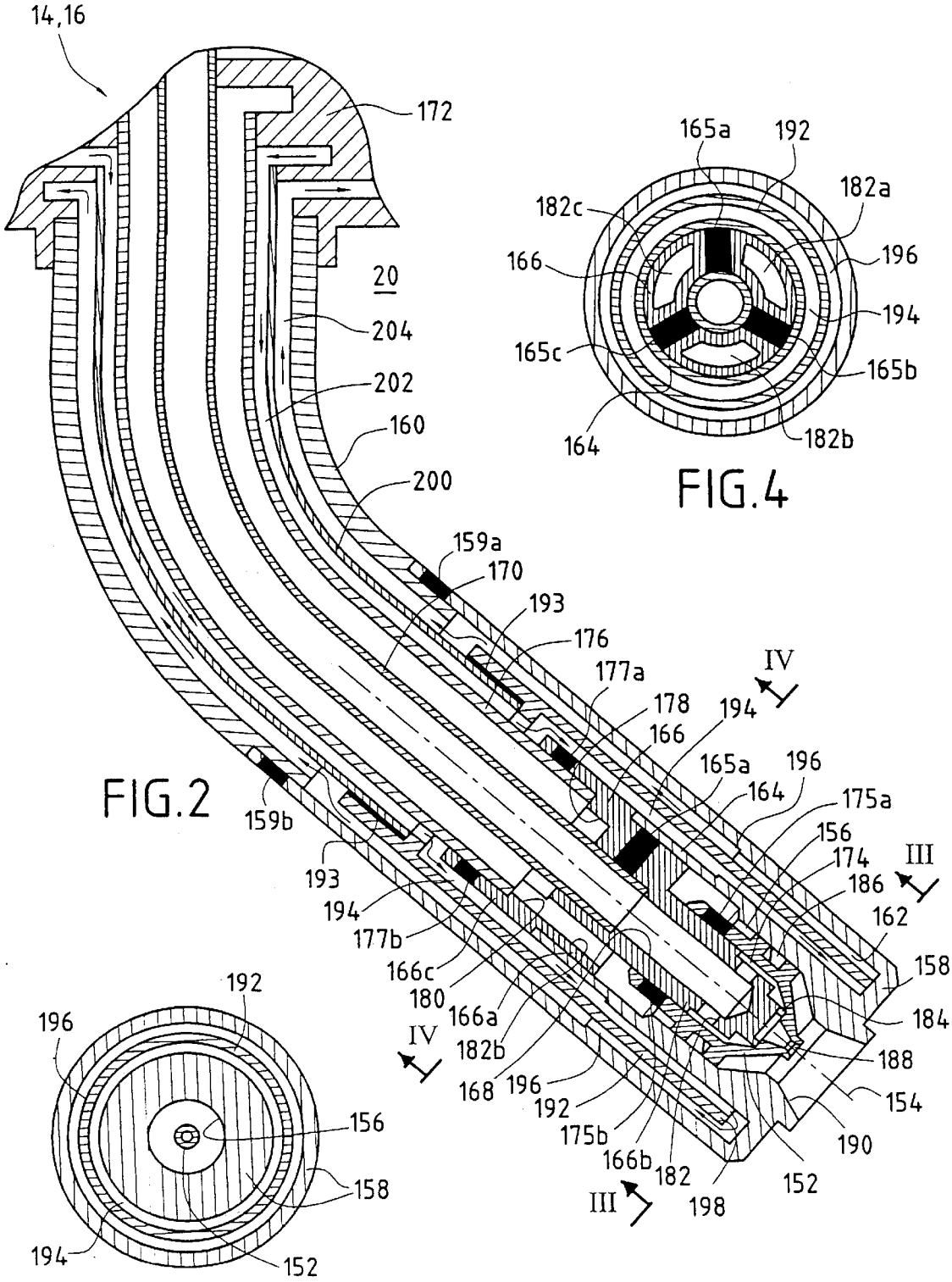
FIG. 2 is a detailed view on a very large scale of a terminal portion of a main injector of the present invention.
FIG. 3 is a section view on plane III—III of FIG. 2.
FIG. 4 is a section view of plane IV—IV of FIG. 2.

FIGS. 2 and 3 show the terminal portion or tip of a main injector 14, 16 of the invention as it extends into a combustion chamber 20. This figure is deliberately greatly enlarged so as to show up its significant details. It should be observed that this end portion of a real injector has a diameter of only about 10 millimeters (mm) to 15 mm.

In this end portion, the injector comprises an annular injection piece 152 having a longitudinal axis 154 (corresponding to the central axis of the injector) mounted in an internal bore 156 of a cylindrical endpiece 158 which is fixed to the end of the outer wall 160 of said injector by brazing. These two parts 158, 160 are brazed together using supplies of brazing metal located in wells 159*a*, 159*b* pierced radially at the upstream end of the endpiece 158 and from which the brazing metal for bonding these two parts together escapes by capillarity during a single heating step. The endpiece has an annular channel 162 which surrounds the internal bore 156 and of depth which extends beyond the end of the annular injection piece 152, and is separated therefrom by a cylindrical sleeve 164 whose upstream end is also fixed by brazing to a cylindrical central portion 166*a* of a connection piece 166. This cylindrical piece 166 has an axial blind bore 168 in its central portion extending into a downstream portion 166*b*, and the free end thereof is fixed, likewise by brazing, to the end of a first feed tube 170 for feeding the primary fuel from the body of the main injector 172 with which this tube is connected upstream (said body itself being fixed in conventional manner to the casing of the turbomachine, not shown). In this case also, the three parts 164, 166*a*, and 170 are brazed together using supplies of brazing metal deposited in wells 165*a*, 165*b*, and 165*c* pierced radially in the central portion 166*a* and from which the metal escapes by capillarity during the heating step so as to unite said central piece with the sleeve 164 and with the central tube 170. The downstream portion 166*b* of the cylindrical piece 166 which presents a diameter smaller than the central portion is partially engaged in and secured by brazing to an internal bore 174 of the annular injection piece 152 (by means of supplies of brazing metal placed in wells 175*a*, 175*b* pierced radially in said annular piece 152), whereas its upstream portion 166*c* which is of diameter greater than that of the central portion (corresponding to the thickness of the sleeve 164) is fixed to the end of a second feed tube 176 by brazing, which second feed tube is coaxial about the first feed tube and of greater diameter, serving to bring secondary fuel from the main injector body 172 to which this second tube is also connected, at its upstream end. Once again, the brazing between these two parts 166*c*, 176 is performed using supplies of brazing metal deposited in wells 177*a*, 177*b* pierced radially in the upstream end of the piece 166*c* and from which the metal escapes by capillarity during a heating step to unite these two parts together. This second tube opens out into an annular internal cavity 178 formed in the upstream portion 166*c* and pierced by longitudinal orifices 180 (e.g. three uniformly distributed orifices) to allow secondary fuel to flow in the piece 166.

The connection piece 166 is also pierced at its blind end by transverse orifices 182*a*, 182*b*, 182*c* for putting its axial bore 168 into communication with the inner bore 174 of the annular injection piece 152 (these transverse orifices preferably alternate with the radial wells 165*a*, 165*b*, 165*c* as shown in FIG. 4). Similarly, its free downstream end is pieced by helical channels 184 (forming the primary swirler 148) for setting into rotation the primary fuel coming from the first feed tube 170 and passing successively through the axial bore 168, the inner bore 174, and the transverse orifices 182. Similarly, the annular injection piece 152 is provided on its outer wall in contact with the internal bore 156 of the cylindrical endpiece 158 with helical grooves 186 (forming the secondary swirler 150) for setting into rotation the secondary fuel coming from the second feed tube 176 and passing successively through the annular cavity 178, the transverse orifices 180, and the internal bore 156. At its free end that is not connected to the connection piece 166, this annular injection piece 152 has a first injection orifice 188 fitted with a primary discharge cone for the primary fuel leaving the helical channels 184. Similarly, for the secondary fuel leaving the helical grooves 186, provision is made for the internal bore 156 of the cylindrical endpiece 158 surrounding the annular piece 152 to be terminated by a second injection orifice 190 carrying a secondary discharge cone concentric with the primary discharge cone.

In addition to the means for delivering primary and secondary fuel to the injector as described above, the main injector also includes specific cooling fluid delivery means enabling the entire injector to be cooled with maximum heat extraction. For this purpose, a tubular separator element 192 is inserted in the annular channel 162 of the endpiece 158 so as to define first and second coaxial annular spaces 194 and 196 on opposite sides of this element, in which spaces the cooling fluid can flow under pressure. The cooling fluid passes between these two annular spaces via a plurality of through orifices 198 formed in said separator element at its downstream end where it rests against the bottom of the channel 162 and extending beyond the first injection orifice 188, thereby guaranteeing cooling all the way to the end of the injector. The upstream end of this separator element is brazed to a third tube 200 which is coaxial about the first and second feed tubes 170 and 176, but of slightly greater diameter, and like those tubes is connected at its upstream end to the body of the injector 172. As for the above-described brazed connections, the parts 192 and 200 can be connected together by means of supplies of brazing metal placed either in wells pierced radially in the upstream end of the separator piece 192 and from which the metal escapes by capillarity during the heating step to unite these two pieces, or more simply from metal 193 spread directly between these pieces. The tube 200 thus defines a first annular duct 202 around the second feed tube 176 to introduce cooling fluid and a second annular duct 204 between said tube 200 and the outer wall of the injector 160 to return cooling fluid to the fluid source 10 after it has traveled along a go-and-return path all along the injector via the annular spaces 194, 196. This go-and-return configuration over the entire length of the primary and secondary fuel feed ducts of a cooling duct that completely surrounds the feed ducts ensures that a maximum amount of heat is removed, unlike prior art devices which usually have a go duct on one side of the injector and a return duct on the other side.

Figure 5:
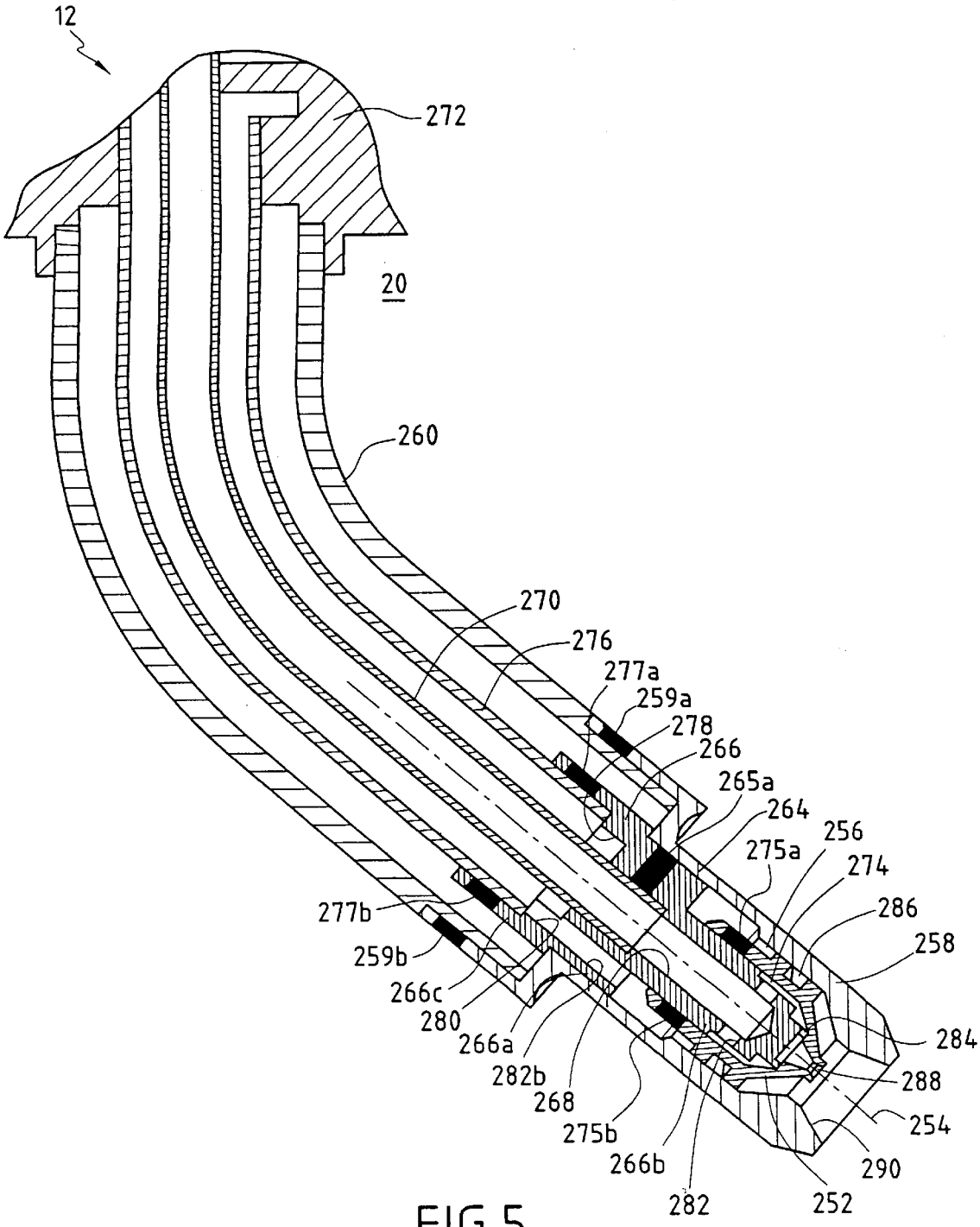
FIG. 5 is a detail view on a very large scale of a terminal portion of a pilot injector of the present invention.

FIG. 5 shows the end portion of a pilot injector assembled in accordance with the invention. The structure of this injector is entirely similar to that of the main injector with the exception of the cooling circuit which is omitted from this injector. The same components are therefore to be found and they are given the same references (except for the first digit). Thus, in this end portion, the pilot injector comprises an annular injection piece 252 on a longitudinal axis 254 mounted in an internal bore 256 of a cylindrical endpiece 258 brazed to the end of the outer wall 260 of the injector. The two pieces 258 and 260 are brazed together from supplies of brazing metal received in wells 259*a*, 259*b* pierced radially in the upstream end of the end piece 258, which metal escapes therefrom by capillarity during a heating step and serves to unite these two pieces securely. In an intermediate portion, the endpiece is also brazed to a cylindrical central portion 266*a* of a connection piece 266. This cylindrical piece 266 has a blind axial bore 268 in said central portion and extending into a downstream portion 266*b*, the free end of the blind bore is brazed to the end of a first feed tube 270 for delivering primary fuel from the pilot injector body 272 to which said tube is connected at its upstream end (with this body itself being fixed in conventional manner to the casing of the turbomachine, not shown). In this case also, the three pieces 258, 266*a*, 270 are brazed together using supplies of brazing metal placed in wells 265*a* pierced radially in the cylindrical central portion 266*a* from which the brazing metal escapes by capillarity during the heating step to bond this central piece securely to the endpiece 258 and to the central tube 270. The downstream portion 266*b* of the cylindrical piece 266 which is smaller in diameter than the central portion is engaged in part inside and is brazed to an inner bore 274 of the annular injection piece 252 (using supplies of brazing metal placed in wells 275*a*, 275*b* pierced radially in said annular piece 252), while its upstream portion 266*c* which presents a diameter greater than that of the central portion is brazed to the end of a second feed tube 276 which is coaxial about the first feed tube and of larger diameter, serving to bring secondary fuel from the pilot injector body 272 to which the second tube is likewise connected at its upstream end. Once again, these two parts 266*c*, 276 are brazed together using supplies of brazing metal placed in wells 277*a*, 277*b* pierced radially in the upstream end of the piece 266*c* and from which it escapes by capillarity during the heating step to unite these two parts. This second tube opens out into an annular internal cavity 278 formed in the upstream portion 266*c* and pierced by longitudinal orifices 280 (e.g. three orifices that are uniformly spaced apart) to allow secondary fuel to flow in the piece 266.

The connection piece 266 is also pierced at its blind end by through orifices 282*b* for putting its axial bore 268 into communication with the inner bore 274 of the annular injection piece 252 (these through orifices preferably alternate with the radial wells). Similarly, its free downstream end is pierced by helical channels 284 (forming the primary swirler 228) for setting into rotation the primary fuel coming from the primary feed tube 270 and passing successively along the axial bore 268, the inner bore 274, and the through orifices 282. Similarly, the annular injection piece 252 is provided in its outer wall in contact with the internal bore 256 of the cylindrical endpiece 258 with helical grooves 286 (forming the secondary swirler 230) for setting into rotation the secondary fuel coming from the second feed tube 276 and passing successively through the annular cavity 278, the transverse orifices 280, and the internal bore 256. At its free end which is not secured to the connection piece 266, this annular injection piece 252 has a first injection orifice 288 provided with a primary discharge cone for the primary fuel leaving the helical channels 284. Similarly, for the secondary fuel leaving the helical grooves 286, provision is made for the internal bore 256 of the cylindrical endpiece 258 surrounding the annular piece 252 to be terminated by a second injection orifice 290 carrying a secondary discharge cone concentric with the primary discharge cone.

Figure 6:
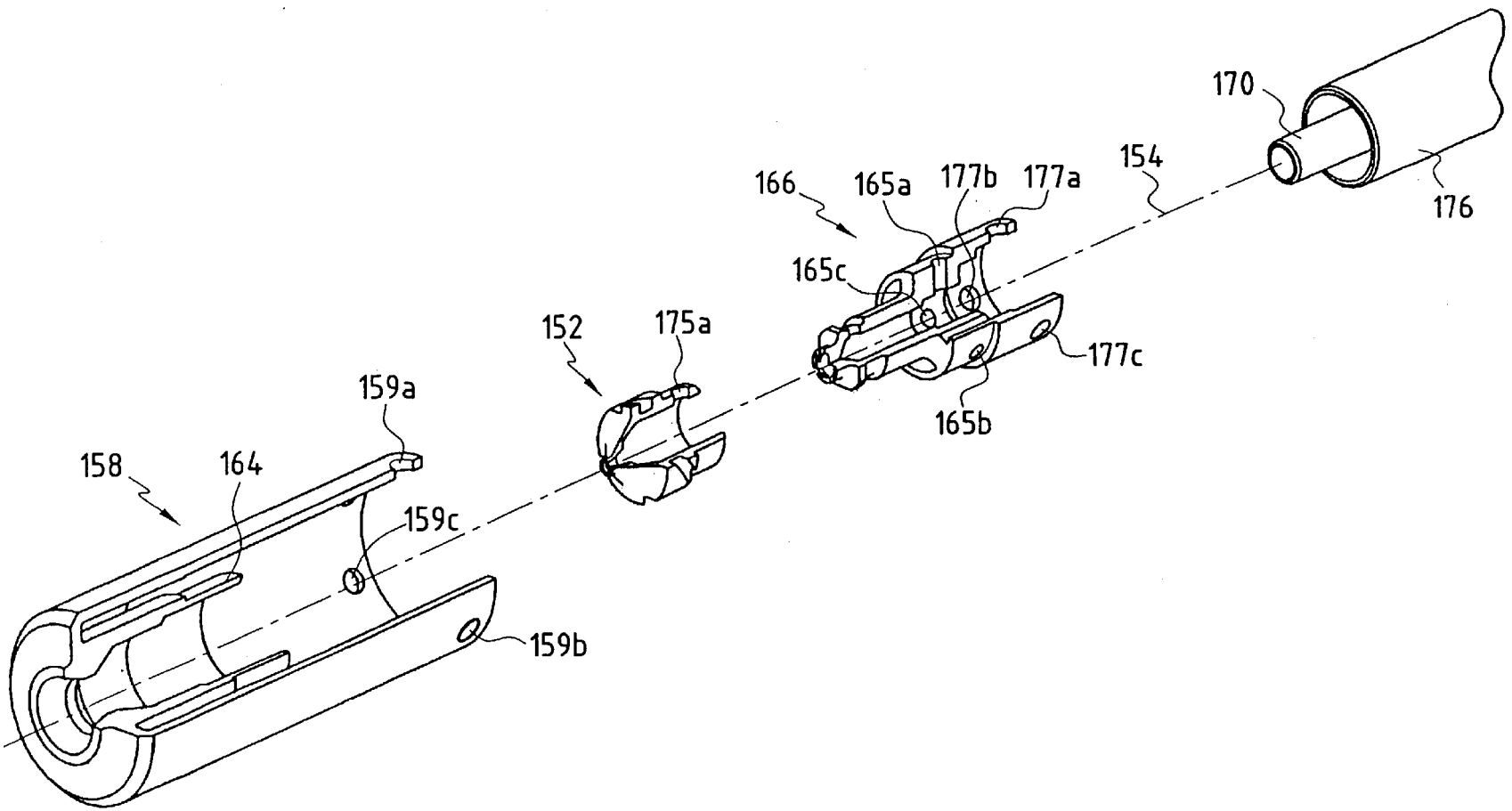
FIG. 6 is an exploded perspective view of the terminal portion of the FIG. 2 injector.
Figure 7:
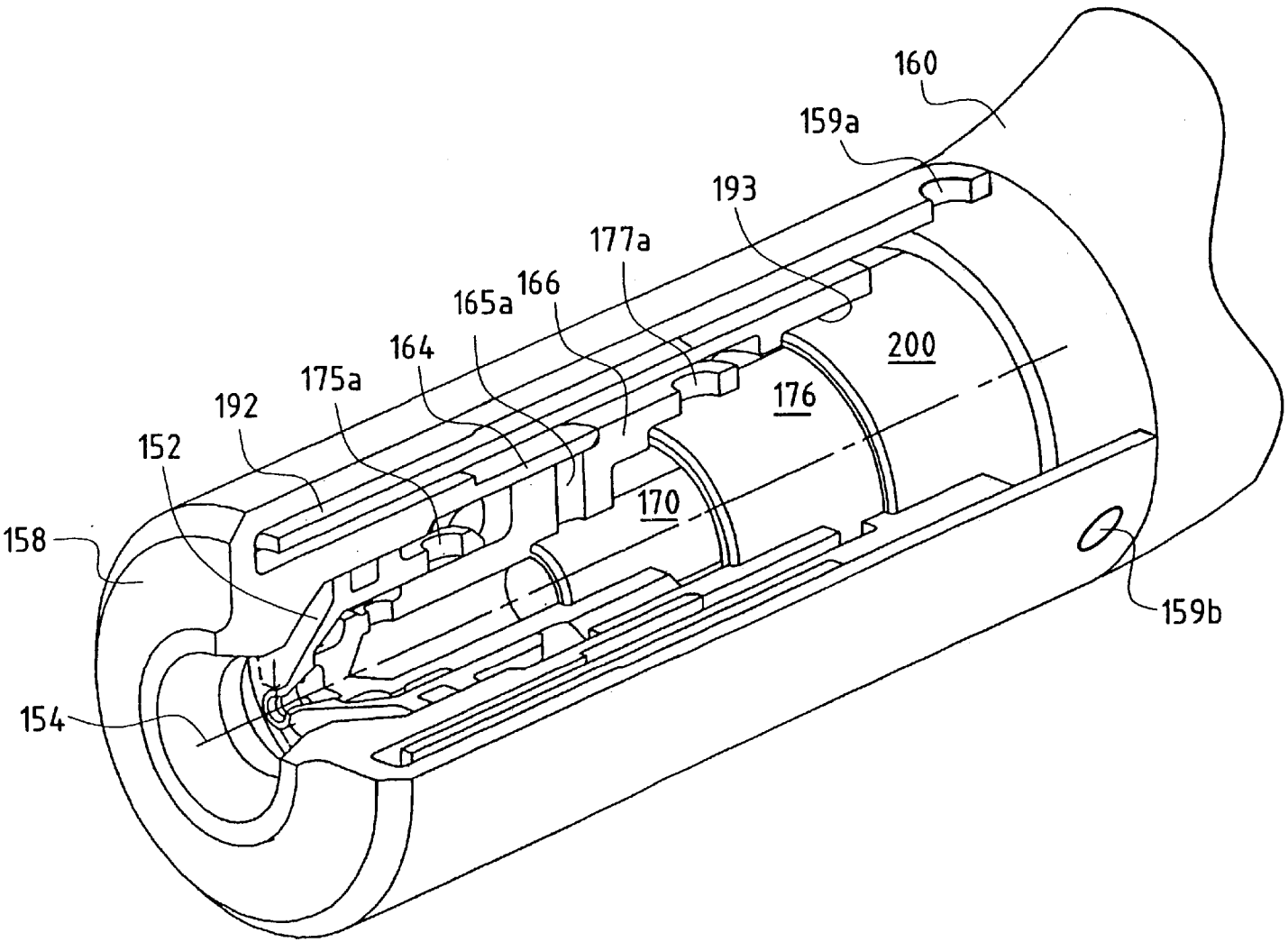
FIG. 7 is a partially cutaway perspective view of the terminal portion of the FIG. 2 injector.

The method of assembling injectors is described below with reference to FIG. 6 which is an exploded view prior to assembly (the separation wall and the outer wall are omitted from the figure) showing the end portion or tip of the main injector as shown in FIG. 2, while FIG. 7 is a partially cut-away perspective view of said end portion after it has been assembled. It will be observed that the same method can be applied to the pilot injector as shown in FIG. 5.

After each of the three parts constituting this injector terminal portion: the endpiece 158, the annular injection piece 152, and the central connection piece 166 (it should be observed that in an embodiment that is not shown, the parts 152 and 166 could be made as a single piece), assembly comprises the following steps: firstly the radial wells are filled with a brazing metal to constitute supplies of brazing metal in each of these three parts; the parts are then assembled together and the resulting assembly is mounted on the primary and secondary feed tubes and then on the outer wall of the injector; finally it is all placed in an enclosure which is heated so as to melt the brazing metal in the parts that have been assembled together in this way.

Brazing can be performed in an oven or by using gas, for example. When brazing by using gas, the parts for assembling together are heated to the "wetting" temperature. As soon as this temperature is reached, the molten brazing metal runs and rises into the 0.05 mm to 0.25 mm clearance (capillary space) that exists between the parts, thereby uniting them. Wetting by means of the brazing metal is encouraged by a flow of gas. When brazing is performed in an oven, it is performed at a temperature lying in the range 600° C. to 1100° C. depending on the nature of the parts to be assembled together and of the brazing metal used. The brazing metal is preferably based on gold or on nickel.

The simplicity of this assembly method based entirely on brazing can make the manufacture of injectors much more reliable since it no longer relies on the quality of bonds that used to be the result of a manual process, nor does it rely on assembling numerous parts together, such as fitting sealing gaskets.

What is claimed is:

1. A method of assembling an end portion of an injector of a turbomachine combustion chamber, the injector comprising a first fuel passage means for delivering primary fuel, said first fuel passage means comprising a first feed tube connected to an annular injection piece having first injection orifices for discharging the primary fuel into said combustion chamber, and second fuel passage means for delivering a secondary fuel, said second fuel passage means comprising a second feed tube surrounding said first feed tube and connected to a cylindrical endpiece surrounding said annular injection piece and having secondary injection orifices for discharging the secondary fuel into said combustion chamber, wherein said cylindrical endpiece and said annular injection piece are provided with radial wells for receiving a brazing metal, the method comprising:

filling the radial wells with said brazing metal;

fitting the annular injection piece in said cylindrical endpiece to form a first subassembly;

fitting the first subassembly on said first and second tubes for feeding primary and secondary fuel, and to an outer wall of the injector to form a second subassembly; and placing the second subassembly in an enclosure where it is heated so as to cause the brazing metal to melt and unite the annular injection piece, the cylindrical endpiece, the first and second tubes, and the outer wall.

2. The assembly method according to claim 1, wherein said annular injection piece is mounted on said first feed tube via a cylindrical connection piece having the radial wells for receiving the brazing metal.

3. The assembly method according to claim 1, further comprising:

a separator wall in said cylindrical endpiece with an upstream end of said separator wall being fixed on a third tube for delivering a cooling fluid and surrounding said first and second feed tubes prior to fitting the first subassembly to the outer wall.

4. The assembly method according to claim 1, wherein said brazing metal comprises at least one of gold and nickel.

5. The assembly method according to claim 1, wherein said enclosure is heated to a determined temperature in a range of 600° C. to 1100° C. based on (i) a characteristic of at least one of the annular injection piece, the cylindrical endpiece, the first and second tubes, and the outer wall and (ii) a characteristic of the brazing metal.

6. The end portion of the fuel injector for the combustion chamber of the turbomachine assembled by the method of claim 1.

7. A method of assembling an end portion of an injector of a turbomachine combustion chamber, the injector comprising a first fuel passage including a first feed tube connected to an annular injection piece, and second fuel passage including a second feed tube surrounding the first feed tube and connected to a cylindrical endpiece surrounding the annular injection piece, wherein the cylindrical endpiece and the annular injection piece are provided with radial wells for receiving a brazing metal, the method comprising:

filling the radial wells with the brazing metal;

fitting the annular injection piece in the cylindrical endpiece to form a first subassembly;

fitting the first subassembly on the first and second tubes for feeding primary and secondary fuel, and to an outer wall of the injector to form a second subassembly; and placing the second subassembly in an enclosure where it is heated so as to cause the brazing metal to melt and unite the annular injection piece, the cylindrical endpiece, the first and second tubes, and the outer wall.

8. The assembly method according to claim 7, wherein the annular injection piece is mounted on the first feed tube via a cylindrical connection piece having the radial wells for receiving the brazing metal.

9. The assembly method according to claim 7, further comprising:

a separator wall in the cylindrical endpiece with an upstream end of the separator wall being fixed on a third tube for delivering a cooling fluid and surrounding the first and second feed tubes prior to fitting the first subassembly to the outer wall.

10. The assembly method according to claim 7, wherein the brazing metal comprises at least one of gold and nickel.

11. The assembly method according to claim 7, wherein the enclosure is heated to a determined temperature in a range of 600° C. to 1100° C. based on (i) a characteristic of at least one of the annular injection piece, the cylindrical endpiece, the first and second tubes, and the outer wall an (ii) a characteristic of the brazing metal.

12. The assembly method according to claim 7, wherein the annular injection piece comprises first injection orifices for discharging a primary fuel into the combustion chamber.

13. The assembly method according to claim 12, wherein the cylindrical endpiece comprises secondary injection orifices for discharging a secondary fuel into the combustion chamber.

14. The assembly method according to claim 7, wherein the cylindrical endpiece comprises secondary injection orifices for discharging a secondary fuel into the combustion chamber.

15. The end portion of the fuel injector for the combustion chamber of the turbomachine assembled by the method of claim 7.

* * * * *